US011877708B2

(12) United States Patent
Zhang

(10) Patent No.: US 11,877,708 B2
(45) **Date of Patent: *Jan. 23, 2024**

(54) CLEANING ROBOT

(71) Applicant: ECOVACS ROBOTICS CO., LTD., Suzhou (CN)

(72) Inventor: Lele Zhang, Suzhou (CN)

(73) Assignee: ECOVACS ROBOTICS CO., LTD., Suzhou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/713,174

(22) Filed: Apr. 4, 2022

(65) Prior Publication Data

US 2022/0225851 A1 Jul. 21, 2022

Related U.S. Application Data

(62) Division of application No. 16/486,486, filed as application No. PCT/CN2018/075093 on Feb. 2, 2018, now Pat. No. 11,317,776.

(30) Foreign Application Priority Data

Feb. 17, 2017 (CN) ..... 201710087268.7

(51) Int. Cl.

| | |
|---|---|
| ***A47L 9/14*** | (2006.01) |
| ***A47L 11/28*** | (2006.01) |
| ***A47L 11/40*** | (2006.01) |
| ***A47L 11/204*** | (2006.01) |

(52) U.S. Cl.

CPC ..... *A47L 11/204* (2013.01); *A47L 9/1409* (2013.01); *A47L 11/28* (2013.01); *A47L 11/4083* (2013.01); *A47L 2201/00* (2013.01)

(58) Field of Classification Search

CPC ..... A47L 11/204; A47L 9/1409; A47L 11/28; A47L 11/4083; A47L 2201/00; A47L 11/4088; A47L 11/40; A47L 11/408

See application file for complete search history.

(56) References Cited

U.S. PATENT DOCUMENTS

| | | | |
|---|---|---|---|
| 2012/0167917 | A1 | 7/2012 | Gilbert, Jr. |
| 2014/0182627 | A1 | 7/2014 | Williams et al. |
| 2016/0287044 | A1 | 10/2016 | Tanaka et al. |

FOREIGN PATENT DOCUMENTS

| | | | |
|---|---|---|---|
| CN | 201861568 | U | 6/2011 |
| CN | 204909295 | U | 12/2012 |
| CN | 203280331 | U | 11/2013 |
| CN | 203662684 | U | 6/2014 |
| CN | 204133376 | U | 2/2015 |
| CN | 204600371 | U | 9/2015 |
| CN | 204654821 | U | 9/2015 |
| CN | 204909295 | U | 12/2015 |

(Continued)

OTHER PUBLICATIONS

ISR of PCT application No. PCT/CN2018/075093 dated May 3, 2018.

(Continued)

*Primary Examiner* — David Redding
(74) *Attorney, Agent, or Firm* — Maschoff Brennan

(57) ABSTRACT

A cleaning robot, includes a body provided with a dust box and a water tank, a water outlet for discharging liquid in the water tank and a dust suction port connected with the dust box are provided with on a bottom of the body, and the water outlet is disposed rearward of the dust suction port and adjacent thereto.

20 Claims, 3 Drawing Sheets

(56) References Cited

FOREIGN PATENT DOCUMENTS

| | | | |
|---|---|---|---|
| CN | 205181253 | U | 4/2016 |
| CN | 105662280 | A | 6/2016 |
| CN | 205306905 | U | 6/2016 |
| CN | 106166050 | A | 11/2016 |
| CN | 205885375 | U | 1/2017 |
| CN | 107440613 | A | 12/2017 |
| CN | 207055441 | U | 3/2018 |
| CN | 207136815 | U | 3/2018 |
| EP | 2918212 | A1 | 4/2009 |
| EP | 2846672 | B1 | 7/2016 |
| EP | 3047782 | A1 | 7/2016 |
| KR | 100635641 | B1 | 10/2006 |
| KR | 101402477 | A | 12/2013 |
| KR | 2013142779 | A | 12/2013 |
| WO | 2013191465 | A1 | 12/2013 |
| WO | 2014105221 | A1 | 7/2014 |
| WO | 2015041036 | A1 | 3/2015 |

OTHER PUBLICATIONS

Written Opinion of PCT application No. PCT/CN2018/075093 dated May 3, 2018.

EP Search Report in Application No. 18753617.2 dated May 26, 2020.

EP Search Report in Application No. 21201116.7 dated Jan. 21, 2022.

Chinese Office Action issued in corresponding application No. 201710087268.7, dated Mar. 1, 2023.

CLEANING ROBOT

FIELD

The present disclosure relates to a cleaning robot.

BACKGROUND

In existing floor cleaning machine that carries a water tank, a water discharge pipeline of which is generally disposed inside the water tank, where a water outlet of the water tank and a mopping component are both located at the bottom of the water tank. When the water discharge pipeline is inside the water tank, it will occupy a partial space thereof and limit the capacity of the water tank, thereby reducing the effective time of operation and increasing the frequency of adding water manually by a user. Since there will be liquid residue inside the water tank due to an over length of the water discharge pipeline (the water in the tank flows out by its own gravity), the water passage should not be made too long, and neither made too short, for this would limit the size of the mopping component and reduce the cleaning efficiency. Particularly, if the selected mopping cloth is a large one, due to the limit of a short water passage, the water outlet will be roughly positioned in the middle of the mopping cloth so that the rear half of the mopping cloth is wet while the front is still dry, thereby reducing the mopping efficiency.

For example, Chinese Patent No. CN204133376U discloses a smart cleaning machine, which mainly includes a cleaning robot body, a water storage tank provided on the body, a water penetration channel at a lower part of the water storage tank and a mopping cloth at a lower part of the water penetration channel, the water penetration channel being in close contact with the mopping cloth. In this prior art, through the water penetration channel, water in the water storage tank flows to the mopping cloth and humidify it, and with water taken in the mopping cloth is then operated to clean the floor. Although the smart cleaning machine solves the problem of dust attached on the floor and some small part of particulates floating in the air, because the water flows to the mopping cloth through the water penetration channel, the liquid at the bottom of the water tank may remain and cannot be exhausted when the pressure in the water tank is insufficient. In addition, because the water flows out by gravity, the mopping cloth cannot be thoroughly humidified, the pipeline cannot be long, and still other defects may exist.

SUMMARY

In view of the deficiencies of the prior art, these and other example problems may be solved by the present disclosure is to provide a cleaning robot. The water discharge pipeline of the present disclosure is independently disposed outside the water tank, so that the capacity of the water tank is increased, without requiring adding water frequently, thereby prolonging the time of operation. Meanwhile, the water discharge pipeline is at least partially located directly below the dust box, to fully utilize the space between the dust box and the bottom wall of the robot body, so that the layout of various parts in the body is more compact and feasible, and a longer water discharge pipeline enables the corresponding cleaning unit to be made larger, by which a working area of the robot is expanded and the working efficiency is enhanced. Additionally, the water discharge pipeline is built within the body, therefore the probability for damage is reduced and the service life of the machine is prolonged.

These and other example problems may be solved by the present disclosure via the following technical solutions:

A cleaning robot includes a body provided with a dust box and a water tank, a cleaning unit, a water outlet mechanism and a water discharge pipeline, the cleaning unit is disposed at a bottom of the body, the water outlet mechanism outputs liquid in the water tank through the water discharge pipeline, the water discharge pipeline is independently disposed outside the water tank, and the water discharge pipeline is at least partially located directly below the dust box.

Additionally or alternatively to reduce the probability for damage and prolong the service life, the water discharge pipeline is disposed inside the body.

The bottom of the body is provided with a water outlet and a dust suction port connected to the dust box. The water outlet is in communication with the water discharge pipeline. A proceeding direction A of the cleaning robot is assumed as forward, then the water outlet is disposed rearward of the dust suction port and adjacent thereto. Additionally or alternatively, the cleaning unit employs a mopping cloth assembly that is mounted at a bottom of the water tank and extends forward at least to be directly below the dust box.

The water discharge pipeline may have various arrangements according to different needs. In one embodiment of the present disclosure, the water discharge pipeline includes a flex pipe and a rigid pipe, one end of the flex pipe is connected to the water outlet mechanism and the other end of the flex pipe is connected to the rigid pipe, and the rigid pipe is provided with a water outlet. Additionally or alternatively, the water discharge pipeline includes a flex pipe, a rigid pipe and an extension pipe, one end of the flex pipe is connected to the water outlet mechanism and the other end of the flex pipe is connected to the rigid pipe, the extension pipe is disposed at a bottom of the rigid pipe, the extension pipe is inserted into a through hole on the bottom wall of the body for positioning, and the extension pipe is provided with a water outlet.

Where, the rigid pipe is disposed directly below the dust box.

Additionally or alternatively, the water discharge pipeline may also include a flex pipe and a water groove, one end of the flex pipe is connected to the water outlet mechanism and the other end of the flex pipe is connected to the water groove on which a water outlet is provided.

Additionally or alternatively, a bottom wall portion of the body extends upward to form a side wall of the water groove.

The water outlet may be provided in plural, and a diameter of a water outlet located at an end of the rigid pipe, the extension pipe or the water groove is greater than a diameter of a water outlet located at a middle of the rigid pipe, the extension pipe or the water groove.

Additionally or alternatively to protect or space-limit the water discharge pipeline, a cover plate is further provided between the water discharge pipeline and the dust box.

Additionally or alternatively, the body is provided with a fan assembly that is disposed at a rear side of the body, and the water tank is at least partially located at a rear end of the fan assembly. Additionally or alternatively, the fan assembly is located between the dust box and the water tank.

Additionally or alternatively to make the overall structure more aesthetic and compact, the water tank is at least partially enclosed around an exterior of the fan assembly. Additionally or alternatively, the water tank includes an arc-shaped section of casing that is surrounded around the exterior of the fan assembly. When the water tank is detachably mounted at a rear end of the body, an outer side wall of the water tank is docked with a side wall of the body, and a bottom wall of the water tank is docked with the bottom wall of the body.

The present disclosure also provides a cleaning robot, which includes a body provided with a dust box and a water tank, a cleaning unit, a water outlet mechanism and a water discharge pipeline, the cleaning unit is provided at a bottom of the body, the water outlet mechanism outputs liquid in the water tank through the water discharge pipeline, wherein the water tank is disposed at a rear end of the body, the dust box is located in front of the water tank, the water discharge pipeline is independently disposed outside the water tank, and the water discharge pipeline extends forward so that the water discharge pipeline is at least partially located in front of a rear side wall of the dust box.

In summation, the present disclosure provides a cleaning robot, the water discharge pipeline is independently disposed outside the water tank, so that the capacity of the water tank is increased, without requiring adding water frequently, thereby prolonging the time of operation. Meanwhile, the water discharge pipeline is at least partially located directly below the dust box, to fully utilize the space between the dust box and the bottom wall of the body, so that the layout of various parts in the body is more compact and feasible, without requiring extra space within the body to accommodate the water discharge pipeline, and a longer water discharge pipeline enables the corresponding mopping cloth assembly to be made larger, by which a working area of the robot is expanded and the working efficiency is enhanced. Additionally, the water discharge pipeline is built within the body, therefore the probability for damage is reduced and the service life of the machine is prolonged.

The technical solutions of the present disclosure will be described in detail below with reference to the accompanying drawings and specific embodiments.

DETAILED DESCRIPTION OF EXAMPLE EMBODIMENTS

Figure 1:
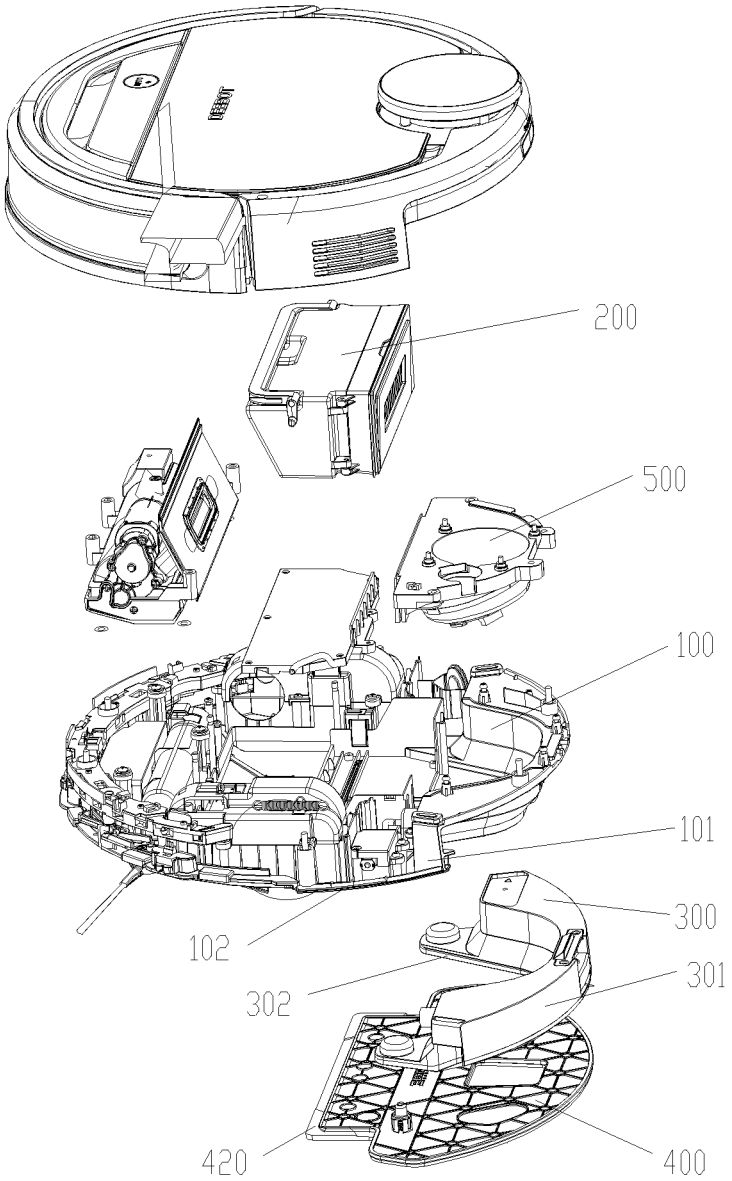
FIG. 1 is an exploded view of an overall structure of a cleaning robot according to the present disclosure.
Figure 2:
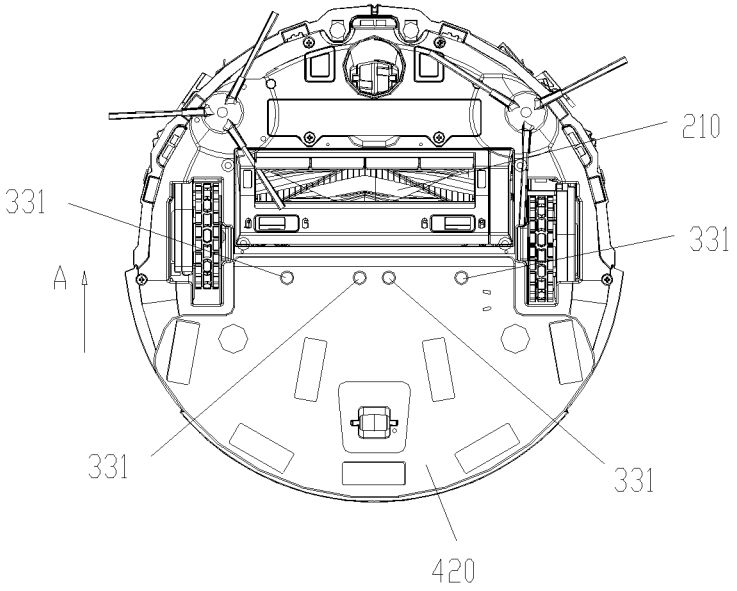
FIG. 2 is one schematic view showing a bottom structure of the cleaning robot according to the present disclosure.
Figure 3:
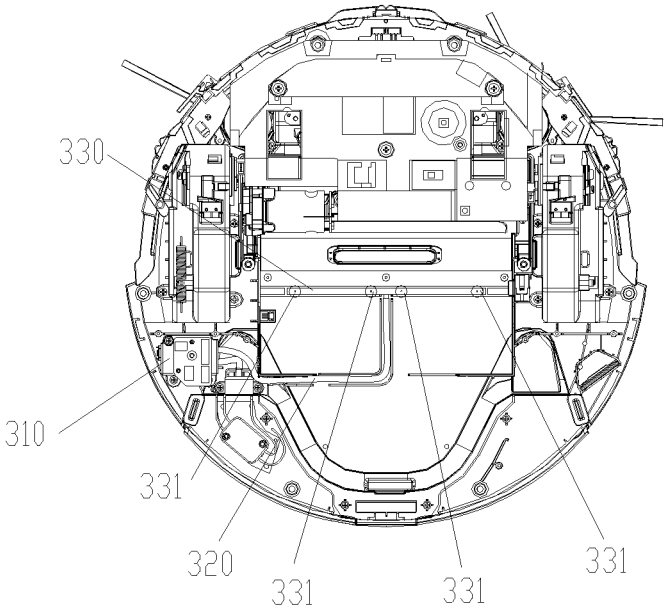
FIG. 3 is a schematic view showing a position of a water discharge pipeline according to the present disclosure.
Figure 4:
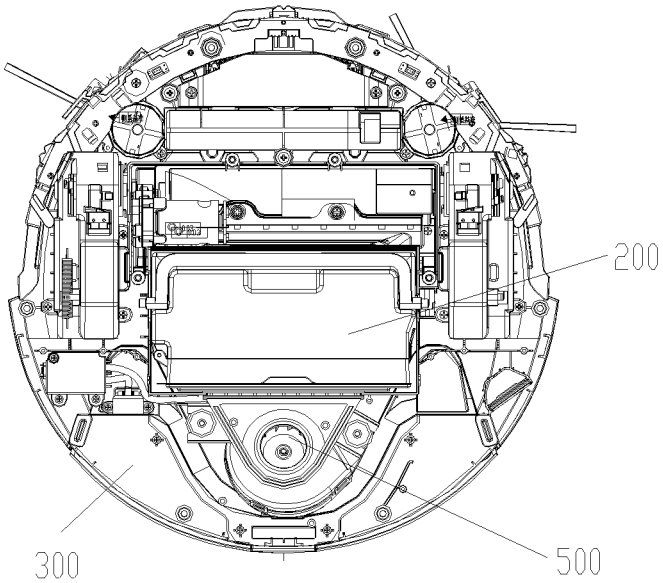
FIG. 4 is another schematic view showing a bottom structure of the cleaning robot according to the present disclosure.

FIG. 1 is an exploded view of an overall structure of a cleaning robot according to the present disclosure; FIG. 2 is one schematic view showing a bottom structure of the cleaning robot according to the present disclosure; FIG. 3 is a schematic view showing a position of a water discharge pipeline according to the present disclosure; and FIG. 4 is another schematic view showing a bottom structure of the cleaning robot according to the present disclosure. For example shown in FIG. 1 to FIG. 4, the present disclosure provides a cleaning robot including a body 100. The body 100 is provided with a dust box 200, a water tank 300, a cleaning unit, a water outlet mechanism 310 and a water discharge pipeline, the cleaning unit is disposed at a bottom of the body 100, the water outlet mechanism 310 outputs liquid in the water tank 300 through the water discharge pipeline. The cleaning unit may include a wide variety of components such as a mopping cloth, a wiper, a roller brush or an edge brush in accordance with the operational requirements of the cleaning robot. In the present embodiment, the cleaning unit is a mopping cloth assembly 400. As shown in FIG. 3 in conjunction with FIG. 1, when the mopping cloth assembly 400 is employed as the cleaning unit, the water in the water tank the water discharge pipeline is output to a mopping cloth 420 in the mopping cloth assembly 400. Additionally or alternatively, the water discharge pipeline is independently disposed outside the water tank 300, and is at least partially located directly below the dust box 200. In order to reduce the probability for damage and prolong the service life, the water discharge pipeline is disposed inside the body 100. At least a part of the water discharge pipeline is located directly below the dust box, to fully utilize the space between the dust box and the bottom wall of the body, so that the layout of various parts in the body is more compact and feasible, without requiring extra space within the body to accommodate the water discharge pipeline. Additionally or alternatively, a longer water discharge pipeline allows the corresponding mopping cloth assembly to be made larger, thereby expanding its working area and improving its work efficiency. As shown in FIG. 2, the bottom of the body 100 is provided with a water outlet 331 and a dust suction port 210 connected to the dust box 200, and the water outlet 331 is in communication with the water discharge pipeline. Additionally or alternatively to quickly water the mopping cloth and increase the wiping area, it is assumed that a proceeding direction A of the cleaning robot is forward, and accordingly the water outlet 331 is positioned rearward of the dust suction port 210 and adjacent thereto. In practical applications, the installation of a distance between the water outlet 331 and the dust suction port 210 also needs to take into consideration the space for installation of the other components on the cleaning robot body, and make the structure as compact as possible without interfering with each other. Of course, the water outlet may also be located a short distance from the front of the mopping cloth assembly. The water in the water outlet first drops to the floor to humidify the dust, and then as the cleaning robot proceeds, the mopping cloth assembly wipes the floor and absorbs the sewage. Preferably, when the mopping cloth assembly is mounted at the bottom of the water tank, the assembly extends forward at least to be directly below the dust box, so that the water outlet is located righteously at an front end of the mopping cloth assembly or slightly in front of the mopping cloth assembly, enabling the water from the water tank to humidify the front end of the mopping cloth assembly in the first time, the mopping cloth assembly to be made larger and the working area to be increased. In order to increase the capacity of the water tank, the water discharge pipeline is built within the body 100, independent of the water tank 300. Additionally or alternatively, a part of the water discharge pipeline may be disposed directly below the bottom of the dust box 200. The water discharge pipeline may have various arrangements according to different needs. For example shown in FIG. 3, in the present embodiment, the water discharge pipeline includes a flex pipe 320 and a rigid pipe 330, one end of the flex pipe 320 is connected to the water outlet mechanism 310 and the other end is connected to the rigid pipe 330, a water outlet 331 is disposed on the rigid pipe. Generally, the water discharge direction may be directed towards the mopping cloth 420 in the mopping cloth assembly 400. Additionally or alternatively, the water discharge pipeline includes a flex pipe, a rigid pipe and an extension pipe, one end of the flex pipe is connected to the water outlet mechanism and the other end is connected to the rigid pipe, and a bottom of the rigid pipe is provided with the extension pipe, the extension pipe is inserted into a through hole on the bottom wall of the body for positioning, and the extension pipe is provided with a water outlet. Since the water in the water tank is directly dripped or sprinkled onto the mopping cloth through the water outlet on the extension, there is no water stain on other parts such as the bottom wall of the body, which effectively prevents an electric short circuit or sewage corrosion caused by the water stain. Therein, the rigid pipe 330 is disposed directly below the dust box 200. The water outlet is provided in plural and is disposed on the rigid pipe 330 at intervals, and a diameter of a water outlet located at an end of the rigid pipe or the extension is greater than a diameter of a water outlet located at a middle of the rigid pipe or the extension. Additionally or alternatively for protection, a cover plate (not shown) is further provided between the water discharge pipeline and the dust box 200. Particularly, the cleaning robot successively includes a bottom wall, a water discharge pipeline, a cover plate and a dust box from the bottom upwardly. In addition, it should be noted that a connection pipe (not shown) is further provided between the water outlet of the water tank and the water outlet mechanism. Usually, the connection pipe is selected to consist of a hose, and the connection manner between the water outlet mechanism and the water tank belongs to the prior art, which will not be described in detail here. Therefore, in the present embodiment, the water flows from the water outlet of the water tank through the connection pipe, and under the action of the water outlet mechanism, flows through the flex pipe to the rigid pipe, and is then discharged to the mopping cloth through the water outlet on the rigid pipe. In addition, for example shown in FIG. 1 in conjunction with FIG. 4, the body 100 is provided with a fan assembly 500 that is disposed at a rear side of the body 100, and the water tank 300 is at least partially located at a rear end of the fan assembly 500. The fan assembly 500 is located between the dust box 200 and the water tank 300. In order to make the overall structure more aesthetic and compact, the water tank 300 is at least partially enclosed around an exterior of the fan assembly 500. Particularly, the water tank 300 includes an arc-shaped section of casing being surrounded around the exterior of the fan assembly 500. Additionally or alternatively, when the water tank is detachably disposed at the rear end of the body, an outer side wall 301 of the water tank 300 is docked with a side wall 101 of the body 100, and a bottom wall 302 of the water tank 300 is docked with a bottom wall 102 of the body 100. That is, the outer wall of the water tank constitutes a part of the side wall of the body, so that the water tank makes full use of the peripheral space of the body while occupying only a small part of the internal space of the body, and the body is allowed to have more internal space for arranging other components, such as a dust box, a fan assembly or drive components for a drive wheel, etc. Meanwhile, a draw-out pluggable rear end of the body on a lateral side of the dust box makes it easier to remove the water tank for adding water, without turning the body or taking out the water tank from the bottom to add water.

For example shown in FIG. 1 to FIG. 4, the water discharge pipeline of the present disclosure is independently disposed outside the water tank 300 and arranged inside the body 100, so that the capacity of the water tank is increased, and the subscriber does not need to frequently add water during use. In addition, since the water outlet 331 is located at the lower portion of the dust box 200 and close to the dust suction port 210, the area of the mopping cloth 420 is largely increased. Then the water outlet 331 is located at the foremost end of the mopping cloth 420, so that as the cleaning robot marches on, the mopping cloth is humidified starting from the front end enabling the mopping to be faster and more efficient. Further, since the water discharge pipeline is built independently outside the water tank 300 within the body 100, although the user still needs to take it out from the body 100 repeatedly when adding water to the water tank 300 during frequent use, the extraction process does not involve the water discharge pipeline, which greatly reduces the probability for a damage in the pipeline; at the same time, the interior of the water tank 300 has no complicated water discharge pipeline, thus making the structure more compact, and even if it is frequently used, the probability for failure will be smaller.

In these or other embodiments, the water discharge pipeline includes a flex pipe 320 and a water groove, one end of the flex pipe is connected to the water outlet mechanism 310 and the other end is connected to the water groove, and a water outlet is provided on the water groove. For fixation, the bottom wall portion of the body 100 extends upward to form a side wall of the water groove. The water outlet 331 is provided in plural. In order to ensure rapid watering of the mopping cloth, a diameter of a water outlet located at an end of the water groove is greater than a diameter of a water outlet located at the middle of the water groove. Similarly, the water discharge pipeline is at least partially disposed directly below the dust box 200. Additionally or alternatively for protection, a cover plate (not shown) is further provided between the water discharge pipeline and the dust box 200. Similarly, in the present embodiment, a connection pipe (not shown) is further provided between the water outlet of the water tank and the water outlet mechanism, the connection pipe is usually selected to consist of a hose, and the connection manner between the water outlet mechanism and the water tank belongs to the prior art which will not be described in detail here. Therefore, in the present embodiment, the water flows from the water outlet of the water tank through the connection pipe, and under the action of the water outlet mechanism, flows through the flex pipe to the water groove, and is then discharged to the mopping cloth through the water outlet on the water groove and the extension.

The other technical features in the present embodiment are the same as those in previous embodiment, which will not be described in detail here.

In these or other embodiments also provide a cleaning robot, which includes a body 100 provided with a dust box 200, a water tank 300, a cleaning unit, a water outlet mechanism 310 and a water discharge pipeline, the cleaning unit is provided at a bottom of the body 100, and the water outlet mechanism 310 outputs the liquid in the water tank through the water discharge pipeline. The water tank is disposed at a rear end of the body, the dust box is located in front of the water tank, the water discharge pipeline is independently disposed outside the water tank, and extends forward so that it is at least partially located in front of a rear side wall of the dust box.

In these or other embodiments, the position for installation of the water discharge pipeline is different from that of the previous embodiments. The water discharge pipeline is no longer located directly below the dust box, but is located at the front of the rear side wall of the dust box to ensure the water outlet is positioned adjacent to the dust suction port, so that the mopping cloth assembly may be made as large as possible. Further, the fan assembly on the body is disposed between the dust box and the water tank.

In summation, the present disclosure provides a cleaning robot, the water discharge pipeline is independently disposed outside the water tank, so that the capacity of the water tank is increased, without requiring adding water frequently, thereby prolonging the time of operation. Meanwhile, at least a part of the water discharge pipeline is located directly below the dust box, to fully utilize the space between the dust box and the bottom wall of the body, so that the layout of various parts in the body is more compact and feasible, without requiring extra space within the body to accommodate the water discharge pipeline, and a longer water discharge pipeline enables the corresponding cleaning unit to be made larger, by which a working area of the robot is expanded and the working efficiency is enhanced. Additionally, the water discharge pipeline is built within the body, therefore the probability for damage is reduced and the service life of the machine is prolonged.

What is claimed is:

1. A cleaning robot, comprising:

a body provided with a dust box, a water tank, and a cleaning unit, wherein, a water outlet for discharging liquid in the water tank and a dust suction port connected with the dust box are provided on a bottom of the body, the water outlet is disposed rearward of the dust suction port and adjacent thereto dust on a surface to be cleaned is sucked into the dust box via the dust suction port, and the cleaning unit is humidified by the liquid discharged from the water outlet to mop the surface to be cleaned; wherein the water outlet is provided below the dust box.

2. The cleaning robot according to claim 1, wherein the water outlet and the water tank are connected via a water discharge pipeline and a water outlet component, the water outlet component outputs the liquid in the water tank through the water discharge pipeline, and the water discharge pipeline is disposed outside the water tank and within the body.

3. The cleaning robot according to claim 2, wherein the water discharge pipeline is at least partially located directly below the dust box.

4. The cleaning robot according to claim 3, wherein the water discharge pipeline comprises a flex pipe and a rigid pipe, one end of the flex pipe is connected to the water outlet component, the other end of the flex pipe is connected to the rigid pipe, and the rigid pipe is provided with the water outlet.

5. The cleaning robot according to claim 4, wherein the rigid pipe is disposed directly below the dust box.

6. The cleaning robot according to claim 4, wherein the water outlet is provided in plural, one of the water outlet provided in plural is close to the flex pipe and another one of the water outlet provided in plural is far away from the flex pipe.

7. The cleaning robot according to claim 4, wherein the water outlet is provided in plural, and the water outlet provided in plural are symmetrical about a center line of the bottom of the dust box.

8. The cleaning robot according to claim 2, wherein the water discharge pipeline comprises a flex pipe and a water groove, one end of the flex pipe is connected to the water outlet component, the other end of the flex pipe is connected to the water groove, and the water groove is provided with the water outlet.

9. The cleaning robot according to claim 8, wherein the water groove is disposed directly below the dust box, the water outlet is provided in plural, and the water outlet provided in plural are symmetrical about a center line of the bottom of the dust box.

10. The cleaning robot according to claim 1, wherein the dust suction port, the water outlet and the water tank are sequentially disposed in height.

11. The cleaning robot according to claim 10, wherein the cleaning unit is disposed on a lower surface of the bottom of the body, and the water tank and the water outlet are disposed above the cleaning unit.

12. The cleaning robot according to claim 10, wherein the body is provided with a fan assembly, the fan assembly is disposed at a rear side of the body, and the water tank is at least partially located at a rear end of the fan assembly.

13. The cleaning robot according to claim 12, wherein the water tank is at least partially enclosed around an exterior of the fan assembly.

14. The cleaning robot according to claim 13, wherein the water tank comprises an arc-shaped section of casing, and the casing is surrounded around the exterior of the fan assembly.

15. The cleaning robot according to claim 14, wherein the water tank is detachably mounted at a rear end of the body, a connector between the water tank and the rear end of the body is disposed on a middle part of the arc-shaped section, and an outlet of the water tank is disposed on one of two ends of the arc-shaped section.

16. The cleaning robot according to claim 14, wherein a port for supplying the liquid of the water tank is disposed on one of two ends of the arc-shaped section.

17. The cleaning robot according to claim 14, wherein the water outlet and the water tank are connected via a water discharge pipeline and a water outlet component, and the water outlet component is provided inside the body and close to an end of the arc-shaped section.

18. The cleaning robot according to claim 11, wherein:

the cleaning unit employs a mopping cloth assembly, the mopping cloth assembly is mounted at the bottom of the water tank, and the mopping cloth assembly extends forward at least to directly below the dust box.

19. The cleaning robot according to claim 2, wherein a cover plate is provided between the water discharge pipeline and the dust box.

20. The cleaning robot according to claim 19, wherein the bottom of the body, the water discharge pipeline, the cover plate and the dust box are sequentially disposed in height.

* * * * *